US012371976B2

(12) United States Patent
Kalwar et al.

(10) Patent No.: US 12,371,976 B2
(45) Date of Patent: Jul. 29, 2025

(54) METHOD AND DOWNHOLE DEVICE FOR PERFORATING AND ISOLATING TIGHTLY SPACED ZONES IN HIGHLY-DEVIATED WELLBORES

(71) Applicant: SAUDI ARABIAN OIL COMPANY, Dhahran (SA)

(72) Inventors: Ghulam Murtaza Kalwar, Udhailiyah (SA); Mohammed A. Asiri, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 223 days.

(21) Appl. No.: 18/181,469

(22) Filed: Mar. 9, 2023

(65) Prior Publication Data

US 2024/0301773 A1 Sep. 12, 2024

(51) Int. Cl.

| | |
|---|---|
| ***E21B 43/119*** | (2006.01) |
| *E21B 33/12* | (2006.01) |
| *E21B 43/26* | (2006.01) |

(52) U.S. Cl.

CPC ..... *E21B 43/119* (2013.01); *E21B 33/12* (2013.01); *E21B 43/26* (2013.01)

(58) Field of Classification Search

CPC ..... E21B 43/119; E21B 33/12; E21B 43/26; E21B 17/10; E21B 17/1078; E21B 17/1042; E21B 17/1057

See application file for complete search history.

(56) References Cited

U.S. PATENT DOCUMENTS 1,827,835 A * 10/1931 Black ..... E21B 17/1057 166/241.3
4,793,412 A 12/1988 Rivas et al.
5,358,040 A * 10/1994 Kinley ..... E21B 17/1021 175/325.3

(Continued)

FOREIGN PATENT DOCUMENTS

CN 203847080 U * 9/2014
CN 111042777 A * 4/2020 ..... E21B 17/1078

(Continued)

*Primary Examiner* — Daniel P Stephenson
(74) *Attorney, Agent, or Firm* — Vorys, Sater, Seymour and Pease LLP

(57) ABSTRACT

A wellbore stimulation operation method includes conveying a downhole assembly into a wellbore a first time, the downhole assembly including a perforating gun and one or more friction-reducing subs operatively coupled to the perforating gun, axially aligning the perforating gun with a production zone penetrated by the wellbore, triggering operation of the perforating gun and thereby creating a plurality of perforations in the production zone, removing the downhole assembly from the wellbore and replacing the perforating gun with a plug, conveying the downhole assembly including the plug into the wellbore a second time, axially aligning the plug with a location downhole from the plurality of perforations, centralizing the plug within the wellbore with the one or more friction-reducing subs such that sealing elements included in the plug are not damaged while traversing the plurality of perforations, and deploying the plug within the wellbore downhole from the plurality of perforations.

20 Claims, 4 Drawing Sheets

(56) References Cited

U.S. PATENT DOCUMENTS 5,947,213 A * 9/1999 Angle ..... E21B 23/00 166/255.2
6,684,965 B1 * 2/2004 Bakke ..... E21B 17/1014 166/241.3
6,688,409 B1 * 2/2004 Murray ..... E21B 17/1057 166/241.1
6,830,103 B2 * 12/2004 Bowles ..... E21B 17/1057 166/241.3
7,188,671 B2 * 3/2007 Al-Zahrani ..... E21B 23/14 166/241.5
7,395,881 B2 * 7/2008 McKay ..... E21B 17/1057 166/241.3
7,434,627 B2 * 10/2008 Turley ..... E21B 17/1042 166/138
7,866,384 B2 1/2011 Hall
9,200,487 B2 * 12/2015 Draper ..... E21B 23/14
9,234,394 B2 * 1/2016 Wheater ..... E21B 17/10
9,803,432 B2 * 10/2017 Wood ..... E21B 17/1071
10,544,663 B2 * 1/2020 Modeland ..... E21B 43/28
10,907,420 B1 * 2/2021 Ford ..... E21B 17/1071
11,028,654 B2 * 6/2021 Ford ..... E21B 17/1057
11,268,356 B2 * 3/2022 Dusterhoft ..... E21B 43/116
11,466,527 B2 * 10/2022 Fuglestad ..... F16L 55/32
11,840,914 B1 * 12/2023 Mao ..... E21B 43/263
2006/0278405 A1 * 12/2006 Turley ..... E21B 23/08 166/385
2014/0131045 A1 * 5/2014 Loiseau ..... E21B 43/119 166/241.1
2015/0000900 A1 * 1/2015 O'Malley ..... E21B 47/107 166/250.01
2015/0083437 A1 * 3/2015 Gourmelon ..... E21B 17/1057 166/241.1
2015/0252621 A1 * 9/2015 Tunget ..... F16C 32/0629 175/325.1
2015/0300113 A1 * 10/2015 Guttormsen ..... E21B 4/18 166/243
2017/0138150 A1 * 5/2017 Yencho ..... E21B 43/14
2019/0040698 A1 * 2/2019 Fuglestad ..... E21B 4/18
2021/0140253 A1 * 5/2021 Fuglestad ..... E21B 17/1057
2022/0081982 A1 * 3/2022 Blois ..... E21B 43/26
2022/0213738 A1 * 7/2022 Harrigan ..... E21B 17/10
2023/0106595 A1 * 4/2023 Eitschberger ..... E21B 43/1185 166/297
2023/0349253 A1 * 11/2023 Zakharia ..... E21B 33/134
2024/0229569 A1 * 7/2024 Sullivan ..... E21B 17/042
2024/0301773 A1 * 9/2024 Kalwar ..... E21B 43/119

FOREIGN PATENT DOCUMENTS

CN 115142823 A * 10/2022 ..... E21B 43/116
WO 2005111368 A1 12/2005

* cited by examiner

METHOD AND DOWNHOLE DEVICE FOR PERFORATING AND ISOLATING TIGHTLY SPACED ZONES IN HIGHLY-DEVIATED WELLBORES

FIELD OF THE DISCLOSURE

The present disclosure relates generally to wellbore stimulation treatments and, more particularly, to the utilization of tailored bottom hole assemblies in highly-deviated wellbores.

BACKGROUND OF THE DISCLOSURE

In order to initialize and optimize hydrocarbon production from drilled oil and gas wells, it is often necessary to perform stimulation operations. Stimulation in highly-deviated or nearly horizontal wells, in particular, frequently includes multi-stage completion operations strategically implemented over the life of a well. In particular, highly-deviated wellbores that encompass multiple producible zones within close proximity of each other, often require specifically tailored stimulation methods and apparatuses to achieve the production goals of the operator.

To accomplish multi-stage operations, a commonly employed perforation technique known as "plug-and-perf" is often utilized. Plug-and-perf operations are deployed most often in cased, horizontal (or nearly horizontal) wells in which the operator wishes to fracture and induce production from multiple production zones or areas of the formation, simultaneously. However, utilization of this technique is not procedurally feasible in wellbores with multiple reservoirs located immediately adjacent to one another. Moreover, simultaneous production from every producible zone of the wellbore is not always the desired outcome. Strategically, operators may find it more efficient to stimulate and produce a single zone at time.

Accordingly an efficient system and methodology is necessary to achieve such an outcome.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore stimulation operation method may include conveying into a wellbore a downhole assembly that may include a perforating gun and one or more friction-reducing subs that may be operatively coupled to the perforating gun. The method may further include axially aligning the perforating gun with a production zone penetrated by the wellbore and triggering operation of the perforating gun, thereby creating a plurality of perforations in the production zone. The method may further include removing the downhole assembly from the wellbore and replacing the perforating gun with a plug and then conveying the downhole assembly including the plug into the wellbore a second time. The method may include axially aligning the plug with a location downhole from the plurality of perforations and centralizing the plug within the wellbore with the one or more friction-reducing subs such that sealing elements included in the plug are not damaged while traversing the plurality of perforations. Lastly, the wellbore stimulation method may include deploying the plug within the wellbore downhole from the plurality of perforations.

According to an embodiment consistent with the present disclosure, a well system may include an oil and gas platform, and a wellbore that may be in communication with the oil and gas platform, wherein the wellbore may be penetrating a subterranean production zone. The well system may further include a downhole assembly configured to be introduced into the wellbore and that may include a plug running tool, a plug operatively coupled to the plug running tool, and a first friction-reducing sub that may be interpose the plug running tool and the plug. The downhole assembly may also include a bottom nose operatively coupled to the plug and a second friction-reducing sub interposing the plug and the bottom nose, wherein the first and second friction-reducing subs centralize the downhole assembly within the wellbore such that sealing elements included in the plug are not damaged while traversing perforation gun perforations defined within the wellbore.

According to an embodiment consistent with the present disclosure, a downhole assembly may include a first, second, and third downhole tools, wherein a first friction-reducing sub may be operatively coupled to and interposing the first and second downhole tools. The downhole assembly may also include a second friction-reducing sub operatively coupled to and interposing the second and third downhole tools, wherein each friction-reducing sub includes an elongate body and one or more friction-reducing elements mounted to the elongate body. Further, the friction-reducing elements may be arranged at an outer diameter greater than an outer diameter of the first, second, and third downhole tools to enable the friction-reducing subs to support and centralize the first, second, and third downhole tools within a wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
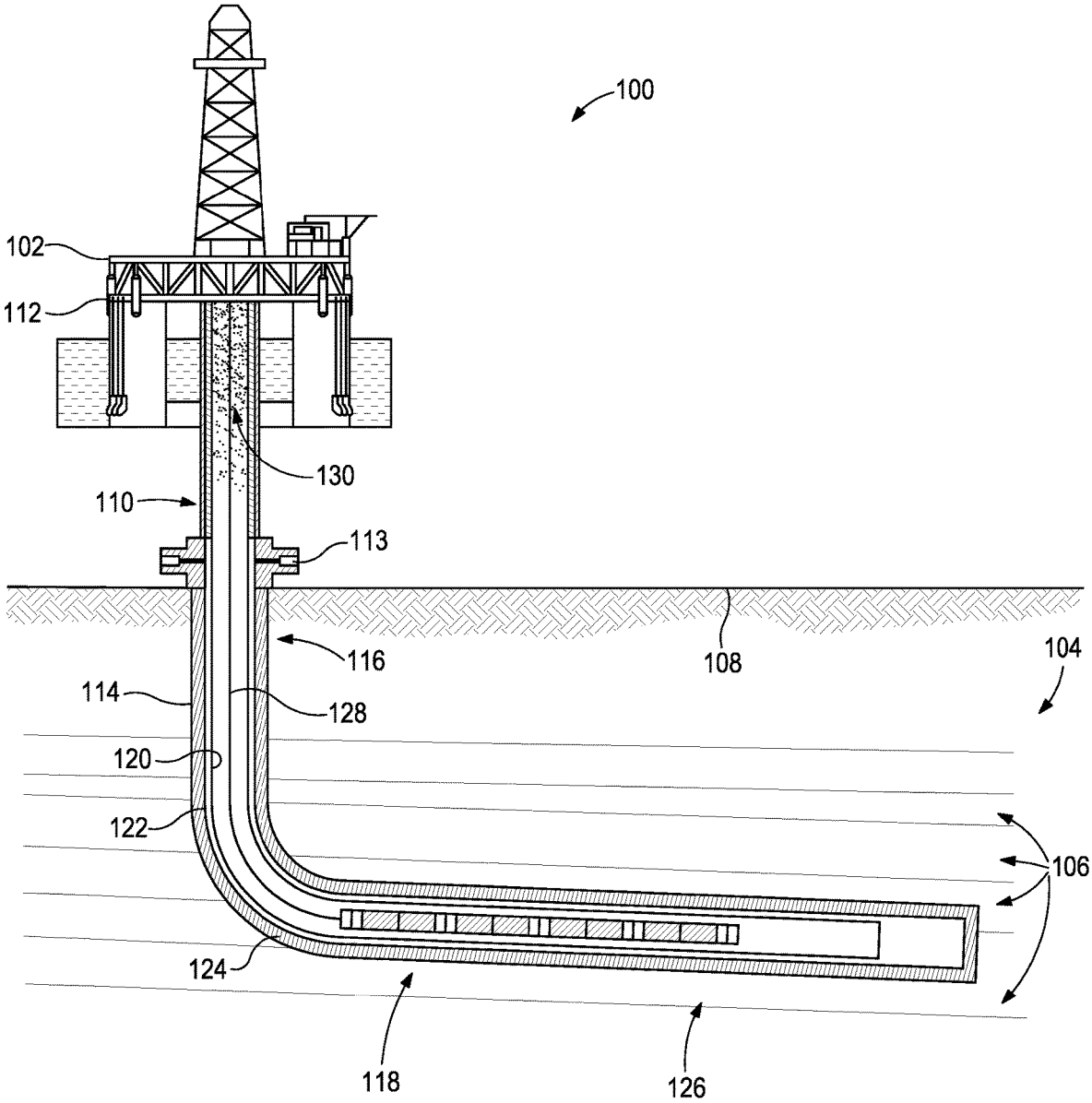
FIG. 1 is a schematic diagram of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to wellbore stimulation treatments. In particular, the present disclosure describes the utilization of tailored bottom hole assemblies deployed in highly-deviated wellbores for stimulating hydrocarbon-producing wells. More specifically, embodiments disclosed herein describe the implementation of one or more friction-reducing apparatuses or "subs" included in downhole assemblies deployed in highly-deviated wellbores with multiple (and closely positioned) producible reservoir zones, for the purpose of perforation and mechanical isolation. Certain embodiments also include the use of a lubricant to help mitigate potential mechanical friction to which deviated wellbores are prone. The disclosure further describes an efficient method for isolating a previously produced zone and stimulating a zone located uphole from and within close proximity to the former. The embodiments described herein may be beneficial in deviated wellbores with densely positioned reservoir zones, wherein the operator desires to complete and produce discrete reservoir zones individually. Additionally, utilization of the method(s) and apparatuses disclosed are advantageous in that they may help to increase the likelihood of wellbore barrier integrity.

FIG. 1 is a schematic diagram of an example well system 100 that may embody or otherwise employ one or more principles of the present disclosure. In the illustrated embodiment, the well system 100 includes an offshore oil and gas platform 102 centered over a submerged oil and gas formation 104 comprising a plurality of producible reservoirs 106 located below a seafloor 108. Even though FIG. 1 depicts the platform 102 being used in an offshore application, it will be appreciated by those skilled in the art that the various embodiments discussed herein are equally well suited for use in conjunction with other types of oil and gas platforms or rigs, such as land-based oil and gas rigs or rigs located at any other geographical site.

A subsea conduit 110 extends from a deck 112 of the platform 102 to a wellhead 113 located at the seafloor 108. A wellbore 114 extends from the wellhead 113 and through various earth strata including the formation 104 and the producible reservoirs 106. The wellbore 114 has an initial, generally vertical portion 116 and a lower, generally deviated portion 118. The wellbore 114 may be lined with one or more strings of casing 122 cemented within the wellbore 114 using cement 124. In at least one embodiment, a string of tubing 120, such as production tubing, may extend from the wellhead 113 (or another location) and be arranged within the casing 122, and both the tubing 120 and the casing 122 may extend at least partially into the deviated portion 118. In other embodiments, a liner (not shown) may be installed within the deviated portion 118 of the wellbore 114, wherein the tubing 120 extending from the wellhead 113 may be secured within the liner top. In some embodiments, the tubing 120 may be omitted, and the embodiments described herein may be undertaken in the wellbore 114 lined with casing 122. In other embodiments, the tubing 120 and the casing 122 may both be omitted from portions of the wellbore 114, and the embodiments described herein may be undertaken in open-hole sections of the wellbore 114. Accordingly, the wellbore 114 may be constructed as operationally necessary without departing from the scope of this disclosure.

The system 100 further includes a downhole assembly 126 extendable into the wellbore 114 on a conveyance 128. In some embodiments, the conveyance 128 may comprise wireline but could alternatively comprise any means of conveyance 128 that enables operability of the tools included in the assembly 126. Examples of such conveyances 128 include but are not limited to, coiled tubing with wire embedded, wired drill pipe, and the like. The downhole assembly 126 (hereinafter referred to as the "assembly 126") may include various downhole tools, devices and systems configured to undertake a number of wellbore stimulation operations, such as the isolation and perforation operations as generally described herein.

FIG. 1 depicts the assembly 126 as arranged within the deviated portion 118 of the wellbore 114. While the assembly 126 is operable within the deviated portion 118, the embodiments described herein are equally applicable for use in the vertical portion 116, or any other deviated or slanted portions of the wellbore 114. The deviated portion 118 may comprise a highly-deviated section of the wellbore 114, where "highly-deviated" refers to an angle exceeding 65° From the vertical portion 116.

In formation 104 that comprises numerous and discrete, producible reservoirs 106 that may also be within close proximity of each other (e.g., less than 30 feet along the wellbore 114) the drilling and completion operations are strategically planned and executed to maximize production from each reservoir 106. Accordingly, the wellbore 114, may be directionally drilled so as to target the thickest portions (or otherwise) of multiple reservoirs 106. As is discussed herein, to accomplish targeted wellbore positioning, the resulting wellbore 114 may be one comprising at least some deviation from vertical, if not a large deviation from vertical. Consequently, the subsequent completion and post-initial production well intervention operations may be planned so that they may be efficiently executed within a deviated wellbore while also meeting the production requirements of the operator.

Completion and well intervention operations may require the use of known stimulation techniques including, but not limited, to perforating. Perforating operations require use of one or more perforating guns deployed by some means of conveyance, such as the conveyance 128. In the present embodiment, the assembly 126 may include one or more perforating guns, and the conveyance 128 may comprise wireline operatively coupled to the upper-most (proximal) section of the assembly 126. Conventional wireline operations are often limited to wellbores exhibiting deviations of less than 60° to 65° primarily due to friction as the wireline loses the benefit of gravity and settles on the low side of the wellbore 114 as the wellbore 114 inclination (or deviation from vertical) increases beyond 65°. Accordingly, as the wellbore 114 approaches horizontal, the wireline will eventually lose all ability to extend into the wellbore 114 without other means of projection/conveyance (e.g., pumping, downhole tractors, etc.).

According to embodiments of the present disclosure, the assembly 126 may include one or more friction-reducing components or subs strategically arranged along the axial length of the assembly 126 to assist in conveying the assembly 126 downhole or toward the distal end of the wellbore 114. The friction-reducing subs may be particularly advantageous in wells with inclinations or deviations that may not be suitable for conventional wireline. Additionally, the friction-reducing subs may help centralize the assembly 126 within the wellbore 114, thereby reducing the mechanical friction between the assembly 126 and the low-side of wellbore 114 in deviated or highly-deviated wells. More specifically, the friction-reducing components may assist in reducing the potential mechanical friction between the assembly 126 and the tubing 120 or the casing 122. In other embodiments, the friction-reducing components may be beneficial in open hole completions where the wellbore 114 is not completely uniform or similarly, in wells in which cuttings beds have formed on the low-side of the wellbore 114.

Detrimental results of mechanical friction due to the assembly 126 contacting the inner walls of the wellbore 114 (e.g., the inner surfaces of the tubing 120, the casing 122, or open hole wellbore 114) can further be mitigated by the use of one or more lubricants. More particularly, it is contemplated herein to use a friction-reducing lubricant soluble in completion brine to diminish mechanical friction in the wellbore 114 undergoing initial completion or post-production intervention operations. Introduction of friction-reducing lubricants is described in further detail below.

Figure 2:
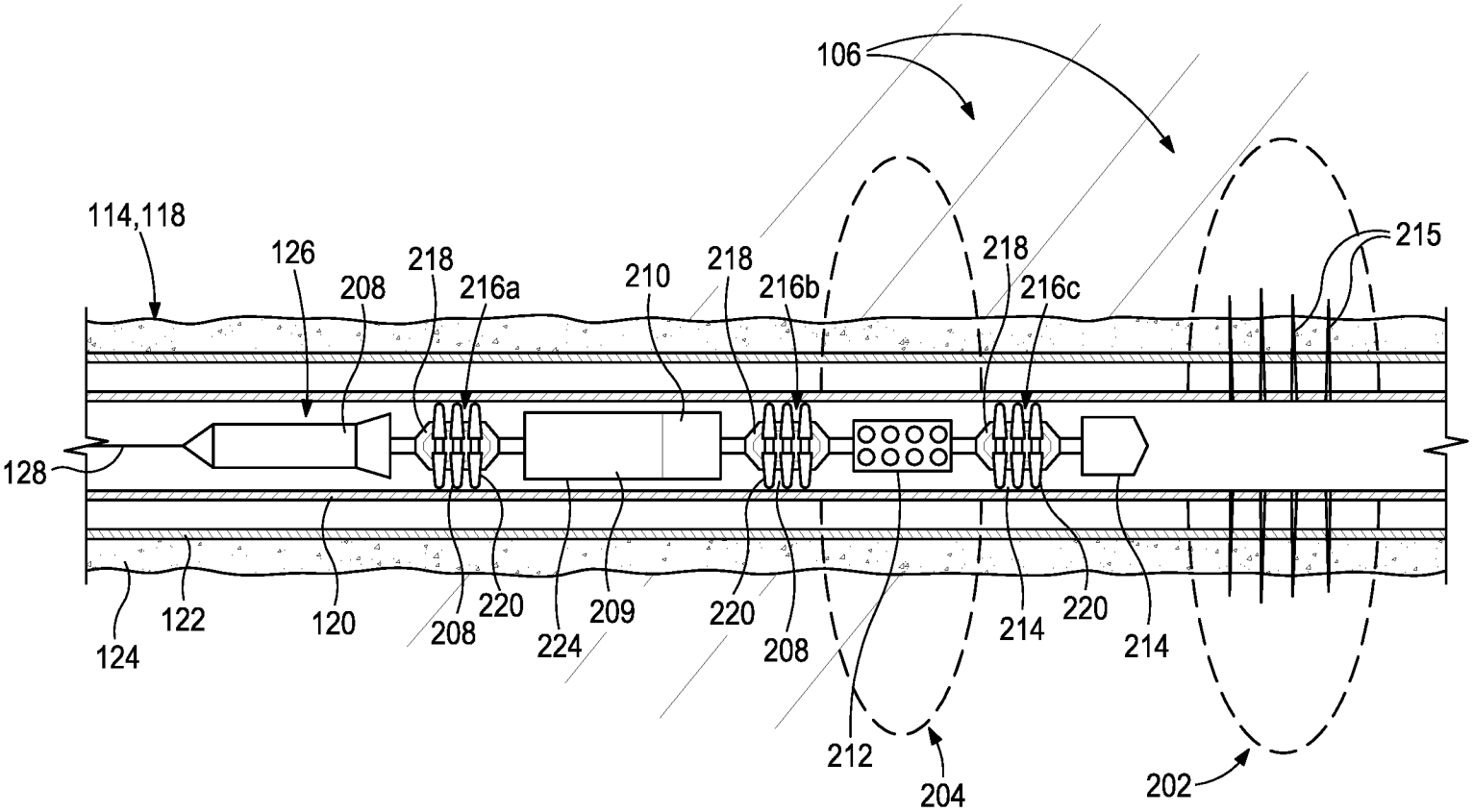
FIGS. 2 and 3 are enlarged schematic side views of a portion of the wellbore of FIG. 1 depicting progressive operational steps of an example wellbore stimulation operation, according to one or more embodiments of the present disclosure.
Figure 3:
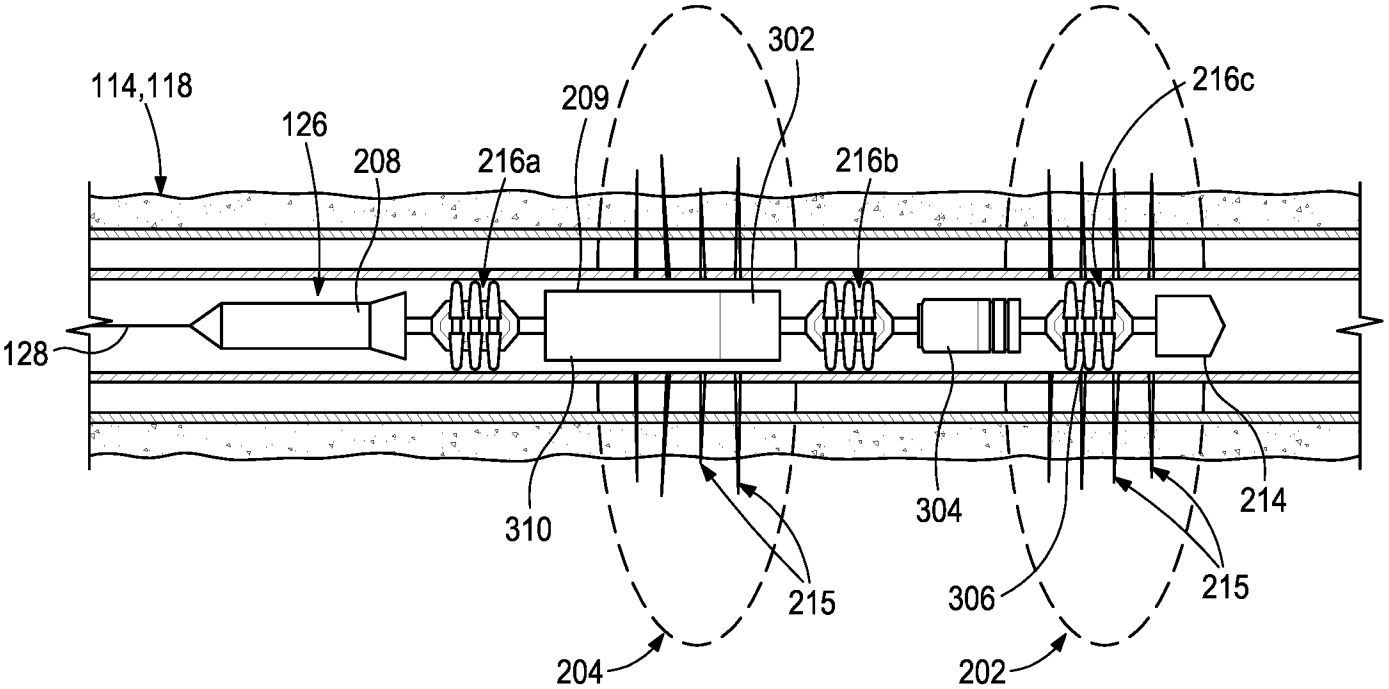

FIGS. 2 and 3 are enlarged schematic side views of a portion of the wellbore 114 depicting progressive operational steps of an example wellbore stimulation operation, according to one or more embodiments of the present disclosure. FIGS. 2 and 3 depict the deviated portion 118 of the wellbore 114, which traverses multiple reservoirs 106 and includes at least two production zones of interest, shown as a first production zone 202 and a second production zone 204. In some embodiments, the first production zone 202 may comprise a zone of interest closest to the total depth of the wellbore 114, and the second production zone 204 may comprise a zone of interest located uphole from the first production zone 202. In at least one embodiment, the distance between the production zones 202, 204 may be less than 30 feet, but could alternatively be other separation distances, without departing from the scope of the disclosure.

While FIGS. 2 and 3 depict the operations being generally undertaken within the deviated portion 118 of the wellbore 114, the presently described operations could alternatively be undertaken in the vertical portion 114 (FIG. 1), or at any point therebetween, without departing from the scope of the present disclosure.

Referring first to FIG. 2, one embodiment of the assembly 126 is depicted as conveyed into the wellbore 114 and, more particularly, into the deviated portion 118 of the wellbore 114, on the conveyance 128. In the illustrated embodiment, the conveyance 128 comprises wireline, but could alternatively be any other the other examples of the conveyance 128 provided herein. The wellbore 114 is lined with the casing 122, which is secured with cement 124, and the tubing 120 may be arranged within the casing 122. In the present embodiment, the assembly 126 is extended within the tubing 120, but the tubing 120 could alternatively be omitted and the assembly 126 may be extended within the casing 122 or within an open-hole section of the wellbore 114, without departing from the scope of the disclosure.

As illustrated, the assembly 126 may include a plurality of downhole tools including, but not limited to, a fishing neck 208, a correlation tool 209, a firing head 210, one or more perforating guns 212, and a bottom nose 214. In the present embodiment, the assembly 126 includes a single perforating gun 212, but could alternatively include multiple perforating guns 212 that may be operationally efficient and tailored to the needs and requirements of the wellbore 114 and/or the reservoirs 106. The fishing neck 208, the correlation tool 209, the firing head 210, the perforating gun 212, and the bottom nose 214 may be collectively referred to herein as "downhole tools" of the assembly 126.

The fishing neck 208 provides a location where the assembly 126 can be operatively coupled to the conveyance 128. The conveyance 128 may also provide a means for communicating with the assembly 126, such as sending and/or receiving signals to/from the correlation tool 209.

The firing head 210 and the perforating gun 212 may be used to create perforations in the walls of the wellbore (e.g., the inner surfaces of the tubing 120, the casing 122, and/or an open-hole section of the wellbore 114) in preparation for production operations. The perforating gun 212 may include a carrier, a liner that encompasses shaped charges, and a detonator cord. Additionally, a detonator (i.e., ignitor) is required to complete the detonation. The detonator can be included in the firing head 210 and operable to ignite the detonator cord, which operatively connects the shaped charges of the perforating gun 212. Once the detonator cord is ignited, by means of a signal received at the firing head 210, the shaped charges within the perforating gun 212 are sequentially or simultaneously fired. Upon detonation, the shaped charges form explosive jets that create a spaced series of perforations 215 extending radially outward through the tubing 120 (or casing), the casing string 122, the cement 124, and into surrounding portions of the formation 104. The perforations 215 help facilitate fluid communication between the formation 104 and the wellbore 114.

In FIG. 2, the first production zone 202 has already been perforated, thus resulting perforations 215 defined through the tubing 120 (or casing), the casing 122, the cement 124 and into the formation 104. Moreover, in the illustrated embodiment, the first production zone 202 has been produced to the point of depletion and the second production zone 204, situated uphole from (or above) the first production zone 202, has not yet been perforated, stimulated, nor produced.

The bottom nose 214 (alternatively referred to as the "nose 214") is positioned at the distal (downhole) end of the assembly 126. The nose 214 comprises a generally cylindrical body that serves as both an endcap and a guide as the assembly 126 is conveyed into the wellbore 114. Additionally, the nose 214 may help centralize the assembly 126 and assist in mitigating potential friction as the assembly 126 is conveyed downhole. In some embodiments, as illustrated, the nose 214 may include a tapered or angled end, but the nose 214 could alternatively be non-tapered, without departing from the scope of the disclosure. In at least one embodiment, the nose 214 may be made of a lubricious material that also aids in reducing friction. Example materials for the nose 214 include, but are not limited to, a polymer, nylon, a polished metal (e.g., aluminum, stainless steel, etc.), or any combination thereof.

According to embodiments of the present disclosure, the assembly 126 may further include one or more friction-reducing components or subs, shown as a first friction-reducing sub 216*a*, a second friction-reducing sub 216*b*, and a third friction-reducing sub 216*c*. As described herein, the friction-reducing subs 216*a-c* may be configured or otherwise operable to help convey the assembly 126 through the deviated portion 118 of the wellbore 114 and minimize friction that would otherwise be generated as the assembly 126 contacts the low-side of the wellbore 114. While three friction-reducing subs 216*a-c* are depicted in FIG. 2, more or less than three may be employed, without departing from the scope of the disclosure.

The friction-reducing subs 216*a-c* may be arranged to axially interpose upper and lower (i.e., uphole and downhole) downhole tools included in the assembly 126. As illustrated, for example, the first friction-reducing sub 216*a* may be operatively coupled to and interpose the fishing neck 208 and a combination of the correlation tool 209 and the firing head 210, the second friction-reducing sub 216*b* may be operatively coupled to and interpose the perforating gun 212 and the combination of the correlation tool 209 and the firing head 210, and the third friction-reducing sub 216*a* may be operatively coupled to and interpose the perforating gun 212 and the nose 214.

The friction-reducing subs 216*a-c* may be operatively coupled to adjacent components of the assembly by a variety of coupling mechanisms including, but not limited to, a threaded engagement, one or more mechanical fasteners, a mechanical engagement (e.g., a bayonet coupling, a J-channel coupling, etc.), an interference fit, or any combination thereof. In at least one embodiment, the coupling mechanism for the second friction-reducing sub 216*b* may be removable or disengageable.

Each friction-reducing sub 216*a-c* may include a generally elongate body 218 and one or more friction-reducing elements 220 mounted to the body 218. In some embodiments, as illustrated, the friction-reducing elements 220 may comprise rolling wheels. In such embodiments, the rolling wheels may provide rolling contact and near-frictionless engagement with the inner wall of the wellbore 114. In other embodiments, however, the friction-reducing elements 220 could alternatively comprise other types of devices or mechanisms capable of engaging the inner wall of the wellbore 114 (e.g., the inner surfaces of the tubing 120, the casing 122, and/or an open-hole section of the wellbore 114) and providing frictionless or near-frictionless contact therewith. Since they are shown in FIG. 2 as rolling elements or wheels, the friction-reducing elements 220 will alternately be referred to herein as "rolling elements 220".

In some embodiments, the rolling elements 220 may be disposed about the exterior of the body 218, and may be arranged to protrude radially outward and beyond the body 218 such that the outer diameter (or outer radial extent) of the rolling elements 220 is greater than an outer diameter of the other components or downhole tools included in the assembly 126. Consequently, the rolling elements 220 will support and centralize the assembly 126 by providing reduced-friction (e.g., rolling) contact with the inner walls of the wellbore 114 (e.g., the inner surfaces of the tubing 120, the casing 122, and/or an open-hole section of the wellbore 114). More particularly, as the assembly 126 is moved downhole or uphole within the wellbore 114, the rolling elements 220 centralize the assembly 126 and prevent the assembly 126 from sagging or making contact with the low-side of the wellbore 114, thus reducing friction generation. As a result, the rolling elements 220 may prove advantageous in helping convey the assembly 126 through the deviated portion 118 of the wellbore 114.

In the present embodiment, the third friction-reducing sub 216*c* is positioned between and directly coupled to the perforating gun 212 and the bottom nose 214. While only one third friction-reducing sub 216*c* is shown, in other embodiments, a plurality of friction-reducing subs 216*c* may be operatively coupled and positioned below the perforating gun 212, without departing from the scope of the disclosure. The number of third friction-reducing subs 216*c* may be determined by the operator in accordance with the operational needs of the assembly 126 and the wellbore 114. Moreover, in at least one embodiment, the nose 214 may include one or more friction-reducing elements (not shown) disposed in or around the body of the nose 214. In such embodiments, the friction-reducing elements of the nose 214 may comprise rolling elements or wheels, similar to the friction-reducing elements 220, but could alternatively comprise other types of devices or mechanisms capable of engaging the inner wall of the wellbore 214 and providing frictionless or near-frictionless contact therewith. The friction-reducing elements of the nose 214 may further assist in centralizing the assembly 126 and conveying it toward the distal end of the wellbore 114 within the deviated portion 118.

In the present embodiment, the second friction-reducing sub 216*b* may be positioned directly above (or uphole from) and operatively coupled to the perforating gun 212. The positioning of the second friction-reducing sub 216*b* directly above the perforating gun 212 particularly assists in centralizing the perforating gun 212 which may be beneficial in generating accurate perforations upon detonation. In some embodiments, the detonator cord may extend through the second friction-reducing sub 216*b*, such as through the interior of the body 218 of the second friction-reducing sub 216*b*.

In the present embodiment, the first friction-reducing sub 216*a* may be arranged within the assembly 126 at some pre-determined distance above the second friction-reducing sub 216*b* and interposing the fishing neck 208 and the combination of the correlation tool 209 and the firing head 210. The operator may configure the number of friction-reducing subs 216*a-c* to best accommodate the geometry of the wellbore 114 so as to provide the greatest amount of centralization for the assembly 126. In determining the configuration of the assembly 126, it may be advantageous to consider the downhole tools that will be included in the assembly 126, the deviation of the wellbore 114, the construction of the wellbore 114 (e.g., whether the assembly 126 will be deployed in open hole or cased hole), and any other factors that may contribute to the performance of the operations.

In deviated wellbores that penetrate multiple reservoirs, such as the wellbore 114 penetrating the reservoirs 106, an operator may determine that completing and producing from a single zone (or limited number of zones) may be more operationally efficient than simultaneously completing and producing all of the reservoirs via traditional "plug-and-perf" completion operations. In traditional "plug-and-perf" completion operations, for instance, multiple zones are stimulated and temporarily isolated, following which the mechanical barriers separating producible zones are removed, thus enabling production from all zones concurrently. A combination perforating and plug setting assembly is utilized to isolate deeper zones and subsequently perforate upper zones. Perforation and subsequent fracture treatment begins first in the deepest production zone after which it is isolated, and continues until all the desired production zones have been perforated, fractured, and mechanically isolated from one another with corresponding plugs. Once stimulation treatment is complete, a milling assembly is deployed to mill the plugs, allowing for unobstructed production through the wellbore.

In wellbores where the distance between reservoirs is less than 30 feet, however, traditional plug-and-perf operations may not be advisable, or even feasible. Generally a minimum of 30 feet of space is necessary between a set plug and a bottom-most perforation charge, since detonation of a charge within 30 feet of a set plug imposes potential risk to the sealing integrity of the plug due to resultant shock waves.

Still referring to FIG. 2, it may not be advisable to employ a conventional plug-and-perf combination assembly to first perforate the second production zone 204 and then subsequently mechanically isolate the (already-depleted) first production zone 202 because it is not procedurally feasible. Conventional plug-and-perf downhole tool configurations require that the plug and perf setting tool be positioned at the most distal end of the assembly, with the perforating guns positioned above the plug setting tool and plug. Upon detonation, any component within the assembly arranged below or downhole from the perforating gun(s) will be communicably severed (and in some embodiments, physically severed) from the components arranged above the perforating guns. Consequently, perforating the second production zone 204 negates the ability to subsequently mechanically isolate the first production zone 202 by means of a plug because the communication and activation capability between the surface and the plug setting tool might be terminated. As such, the present disclosure describes the deployment of two embodiments or configurations of the assembly 126 to accomplish the perforation of the second production zone 204 and the subsequent isolation of first production zone 202.

In example operation of the assembly 126 shown in FIG. 2, the assembly 126 is advanced into the wellbore 114 and positioned so that the perforating gun 212 is axially aligned with the second production zone 204. The friction-reducing subs 216*a-c* may help the assembly 126 advance to the second production zone 204, even in highly-deviated wells. Once aligned with the second production zone 204, the perforating gun 212 may be detonated to generate a plurality of perforations (see FIG. 3) through the inner walls of the wellbore 114 (e.g., the inner surfaces of the tubing 120, the casing 122, and/or an open-hole section of the wellbore 114). The resulting perforations provide conduits through which hydrocarbons (e.g., oil and gas) can migrate into the wellbore 114 for production. Following detonation, the assembly 126 shown in FIG. 2 may be removed from the wellbore 114 by retracting the conveyance 128 back to the well surface.

In some embodiments, the perforating gun(s) 212 may be expendable or otherwise obliterated upon firing. In such embodiments, the third friction-reducing sub 216*c* and the bottom nose 214 may be disengaged and communicably severed from the upper portions of the assembly 126 such that they remain within the wellbore 114. Accordingly, the third friction-reducing sub 216*c* may alternatively be referred to herein as a "sacrificial" friction-reducing sub, and the bottom nose 214 may alternately be referred to herein as a "sacrificial" bottom nose. Following detonation, the assembly 126 (or the portion of the assembly 126 above the perforating gun(s) 212) may be removed from the wellbore 114 by retracting the conveyance 128. At the well surface, the assembly 126 may be reconfigured for a subsequent well isolation operation, as discussed below.

Referring now to FIG. 3, another embodiment of the assembly 126 is depicted, in conjunction with a next progressive step of the example wellbore stimulation operation, according to one or more embodiments. The assembly 126 of FIG. 3 may be similar in some respects to the assembly 126 shown in FIG. 2, and therefore may be best understood with reference thereto, where like numerals will represent similar components not described again in detail. Similar to the assembly 126 of FIG. 2, for example, the assembly 126 in FIG. 3 may be conveyed into the wellbore 114 on the conveyance 128 and, more particularly, into the deviated portion 118 of the wellbore 114. Moreover, the assembly 126 of FIG. 3 includes a plurality of downhole tools including, but not limited to, the fishing neck 208, the correlation tool 209, and the bottom nose 214. Unlike the assembly 126 of FIG. 2, however, the assembly 126 in FIG. 3 may include a plug setting tool 302 operatively coupled to the correlation tool 209, and a plug 304 arranged downhole from the plug setting tool 302.

Moreover, similar to the assembly 126 of FIG. 2, the assembly 126 in FIG. 3 may include one or more friction-reducing subs, shown as the first friction-reducing sub 216*a*, the second friction-reducing sub 216*b*, and the third friction-reducing sub 216*c*. The first friction-reducing sub 216*a* may be operatively coupled to and interpose the fishing neck 208 and a combination of the correlation tool 209 and the plug setting tool 302, the second friction-reducing sub 216*b* may be operatively coupled to and interpose the plug 304 and the combination of the correlation tool 209 and the plug setting tool 302, and the third friction-reducing sub 216*a* may be operatively coupled to and interpose the plug 304 and the nose 214. In other embodiments, the assembly 126 may comprise any combination of friction-reducing subs 216*a-c* that may be operational efficient and tailored to the needs and requirements of the wellbore 114 and/or the reservoirs 106.

In FIG. 3, the assembly 126 is arranged within the tubing 120 following the previously-described perforating operation, thereby resulting in a plurality of perforations 215 extending radially outward through the tubing 120, the casing string 122, the cement 124, and into the second production zone 204. In other embodiments, however, the tubing 120 may be omitted and the assembly 126 may alternatively be arranged within the casing 122. In such embodiments, the perforations 215 may extend radially outward through the casing 122 and the surrounding cement 124 and into the second production zone 204. In yet other embodiments, both the tubing 120 and the casing 122 may be omitted, and the assembly 126 may instead be arranged within an open hole section of the wellbore 114. In such embodiments, the perforations 215 may extend radially outward and into the second production zone 204.

The plug setting tool 302 may be operatively coupled to the plug 304 and thereby operable to deploy (actuate) the plug 304 at a desired location within the wellbore 114 and thereby secure the plug 304 against the inner radial surface of the tubing 120, or alternatively against the inner radial surface of the casing 122 or the inner radial surface of the wellbore 114. In the present embodiment, the second friction-reducing sub 216*b* interposes the plug 304 and the plug setting tool 302. In such embodiments, the plug setting tool 302 may be configured to actuate the plug 304 through the second friction-reducing sub 216*b*. In other embodiments, however, the plug 304 and plug setting tool 302 may be directly coupled. In such embodiments, the second friction-reducing sub 216*b* may be positioned at another location within the assembly 126 to support and centralize the plug setting tool 302 and the plug 304.

The plug 304 may include a plurality of slips (not shown) having hardened edges that latch or "bite" into the inner radial surface of the tubing 120 upon actuation. Moreover, the plug 304 may also include an element configured to radially expand upon actuation to sealingly engage the inner radial surface of the tubing 120 (or the casing 122 or the wellbore 114, depending on the configuration). The resultant sealed interface isolates portions of the tubing 120 uphole and downhole of the plug 304. In this embodiment, the portion downhole of the plug 304 includes the isolated portions of the wellbore 114 (i.e., the first production zone 202 and related perforations 215) as well as any downhole tools arranged downhole from the plug 304 (i.e., the third friction-reducing sub 216*c* and the bottom nose 214).

In some cases, the plug 304 may be at least partially made of a soft material (e.g., soft metals, composite materials, polymers, etc.). Similarly, the plug 304 may include expandable rubber or elastomeric elements that are disposed around the body of the plug 304 for the purposes of creating a seal with the interior of the tubular 120 in which it is actuated. Accordingly, the plug 304 could be susceptible and subject to damage if conveyed through portions of the wellbore 114 that have been previously perforated (i.e., location of the perforations 215). Perforated tubulars may be permeated by perforation burrs that may damage the sealing elements of the plug 304 if contacting the burrs as the assembly 126 is conveyed past such perforated sections. In the present example, if the assembly 126 were advanced past the first production zone 202, the sealing elements of the plug 304 may be exposed to perforation burrs resulting from the perforations 215 created at the first production zone 204. Damage to the sealing elements may compromise the sealing integrity of the plug 304, and a lack of sealing integrity may result in inefficient subsequent stimulation treatments (e.g., fracture treatments implemented post-perforation) and ineffectual production due to poor isolation.

In the present embodiment, the assembly 126 may be advanced within the wellbore 114 until the plug 304 is positioned above (uphole from) the first (already-depleted) production zone 202, but below (downhole from) the second (newly perforated) production zone 204. The friction-reducing subs 216*a-c* assist in conveying the assembly 126 through the wellbore 114 and, more particularly through the deviated portion 118 of the wellbore 114. Moreover, the friction-reducing subs 216*a-c* also help centralize the assembly 126 within the wellbore, thus centralizing the plug 304 and thereby preventing potential damage to the sealing elements of the plug 304 as the plug 304 it is conveyed past the perforations 215 defined in the second production zone 204.

Once the assembly 126 is properly positioned within the wellbore 114, the plug 304 may be set within the tubing 120 using the plug setting tool 302. Setting the plug 304 results in isolation of uphole and downhole portions of the wellbore 114. Once the plug 304 is properly set within the tubing 120, the plug setting tool 302 may release from the plug 304 such that portions of the assembly 126 positioned above the plug 304 disengage from the plug 304. In at least one embodiment, the plug 304 releases from the assembly 126 at the second friction-reducing sub 216*b*. Accordingly, the second friction-reducing sub 216*b* may be removable or detachable from the plug 304. In some applications, for example, an axial load (i.e., tension) may be applied on the conveyance 128, which transmits a shear force to decouple the plug 304 from the uphole portions of the assembly 126. In other embodiments, however, a signal may be sent to the plug setting tool 302, which may be configured to operate one or more servos to mechanically release the plug 304 from uphole portions of the assembly 126.

Once disengaged, the portion of the assembly 126 uphole from the plug 304 may be removed from the wellbore 114 by retracting the conveyance 128. Portions of the assembly 126 located downhole from the plug 304, and including the plug 304 itself, may remain within the wellbore 114. Accordingly, as mentioned above, the third friction-reducing sub 216*c* may alternately be referred to herein as a "sacrificial" friction-reducing sub, and the bottom nose 214 may alternately be referred to herein as a "sacrificial" bottom nose.

The procedural steps of the foregoing wellbore stimulation operation disclosed and illustrated in FIGS. 2 and 3 may be repeated as many times as operationally efficient and in accordance with the number of reservoirs 106 positioned within close proximity to each other. Additionally, the order of operations disclosed in the present embodiment should not be considered limiting. It will be understood by those in the art that the changes to the order of operations may be modified so as to be operationally efficient to the wellbore 114.

Referring again to FIG. 1, in some embodiments, in order to further reduce friction within the wellbore 114, which may further help the assembly 126 (of FIG. 2 or 3) advance into the wellbore 114, a friction-reducing lubricant 130 may be pumped into the wellbore 114 prior to introducing the assembly 126. In such embodiments, the well operator may inject the friction-reducing lubricant 130 into the wireline pressure control equipment, or more specifically, the lubricator. The lubricant 130 may be injected so as to fill the lubricator/riser to the wireline BOP level prior to conveying any assembly 126 into the wellbore. Accordingly, as the assembly 126 is conveyed into the wellbore 114, the friction-reducing lubricant 130 may travel with the assembly 126, thus further assisting in reducing the potential friction between the assembly 126 and the interior walls of the tubular (e.g., tubing 120, and/or casing 122). Similarly, friction reducing lubricant 130 may be injected at any point in the procedure when it is operationally efficient to do so. At least one example of the friction-reducing lubricant 130 is a brine lubricant, such as RADIAGREEN® EBL lubricant available from BRI-CHEM, RX-72TL of RAMEX in Norway.

Figure 4:
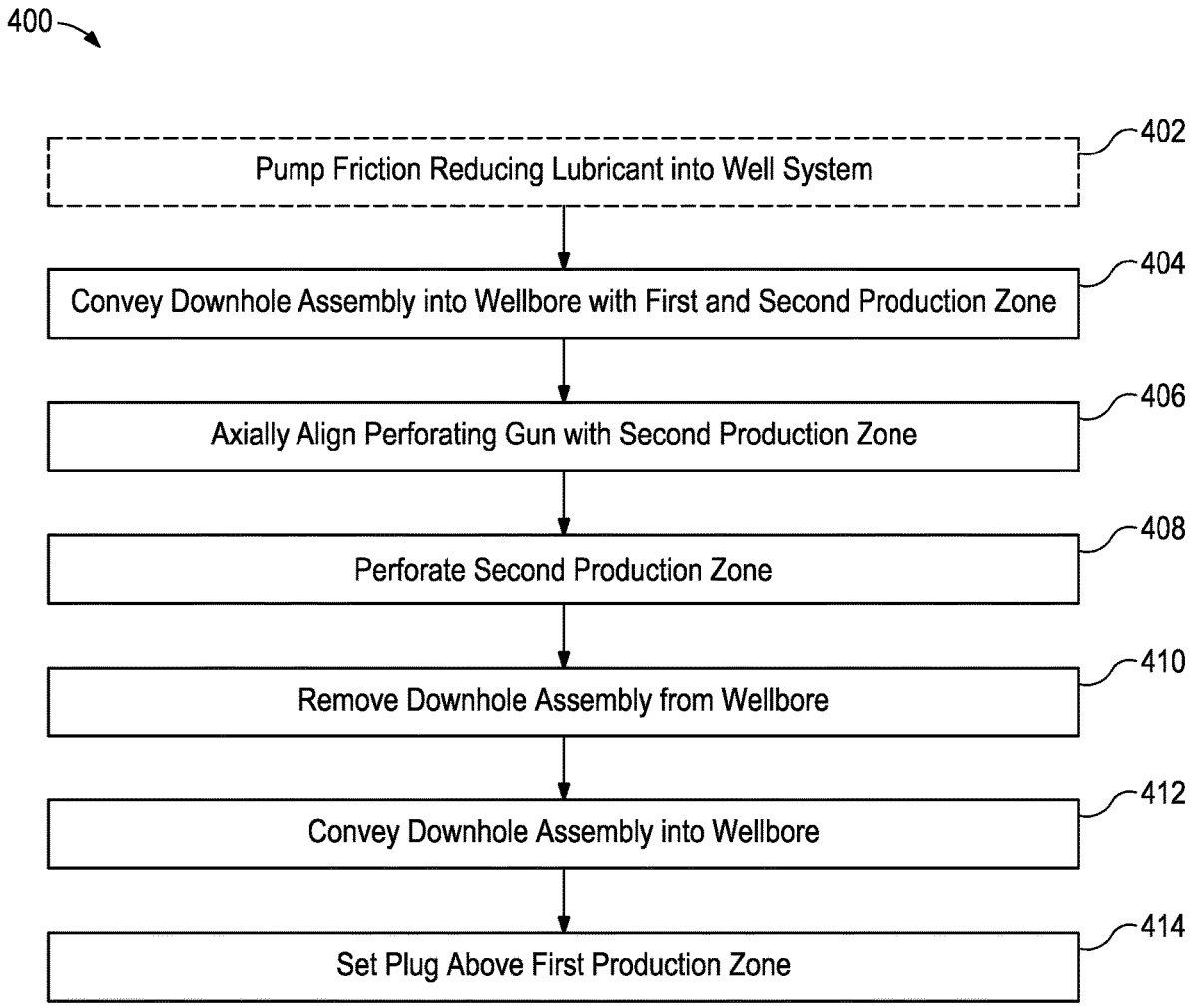
FIG. 4 is a schematic flowchart of an example wellbore stimulation operation method, according to one or more embodiments.

FIG. 4 is a schematic flowchart of an example wellbore stimulation operation method 400, according to one or more embodiments. As illustrated, the method 400 may optionally include pumping a friction-reducing lubricant into the wellbore of a well system, as 402. As briefly mentioned above, the friction-reducing lubricant may be pumped into the lubricator/riser at the well surface, but could alternatively be introduced in other ways, without departing from the scope of the disclosure. The friction-reducing lubricant may prove advantageous in reducing mechanical friction that may be generated upon subsequently introducing downhole assemblies into the wellbore.

The method may further include conveying a downhole assembly into a wellbore, as at 404. In some embodiments, the downhole assembly may be conveyed downhole on wireline and into a deviated or highly-deviated portion of the wellbore. The wellbore includes at least one or more production zones located within close proximity (~30 feet or less), wherein the distal most production zone may be depleted. In some embodiments, the wellbore may be lined with casing and tubing may be arranged within the casing. In such embodiments, the downhole assembly may be conveyed downhole within the tubing. In other embodiments, however, the tubing may be omitted and the downhole assembly may be extended downhole within the casing. In yet other embodiments, the downhole assembly may be advanced to an open-hole section of the wellbore.

The downhole assembly may include one or more perforating guns and one or more friction-reducing subs used to help convey the downhole assembly into the wellbore. In some embodiments, the friction-reducing subs may be positioned immediately adjacent the distal and proximal ends of the perforating gun(s). The method 400 may further include axially aligning the one or more perforating guns with a second production zone positioned immediately above (uphole from) a depleted first zone, as at 406. The perforating guns may then be triggered (detonated) to create one or more perforations in the second production zone, as at 408. The downhole assembly including the perforating gun(s) may then be removed from the wellbore, as at 410.

The method 400 may further include conveying the downhole assembly into the perforated wellbore a second time, as in 412. On its second run downhole, the perforating gun(s) may be replaced with a plug, and the downhole assembly may also include a plug setting tool. Again, one or more friction-reducing subs may be included in the downhole assembly to help convey the downhole assembly into the wellbore. In some embodiments, the friction-reducing subs may be positioned immediately adjacent to the distal and proximal ends of the plug.

The method 400 further includes setting the plug above the first production zone, as at 414. Once the plug is set, the downhole assembly may be removed from the wellbore, while the plug and downhole tools arranged distal to the plug remain within the wellbore and are considered "sacrificial" tools.

Embodiments disclosed herein include:

A. A wellbore stimulation operation method, the method including conveying a downhole assembly into a wellbore a first time, the downhole assembly including a perforating gun and one or more friction-reducing subs operatively coupled to the perforating gun. The method further including axially aligning the perforating gun with a production zone penetrated by the wellbore, triggering operation of the perforating gun and thereby creating a plurality of perforations in the production zone, and removing the downhole assembly from the wellbore and replacing the perforating gun with a plug. The method further including conveying the downhole assembly including the plug into the wellbore a second time, axially aligning the plug with a location downhole from the plurality of perforations, centralizing the plug within the wellbore with the one or more friction-reducing subs such that sealing elements included in the plug are not damaged while traversing the plurality of perforations and deploying the plug within the wellbore downhole from the plurality of perforations.

B. A well system, the well system including an oil and gas platform, a wellbore in communication with the oil and gas platform and penetrating a subterranean production zone, a downhole assembly configured to be introduced into the wellbore. The downhole assembly including a plug running tool, a plug operatively coupled to the plug running tool, a first friction-reducing sub interposing the plug running tool and the plug, a bottom nose operatively coupled to the plug and a second friction-reducing sub interposing the plug and the bottom nose, wherein the first and second friction-reducing subs centralize the downhole assembly within the wellbore such that sealing elements included in the plug are not damaged while traversing perforation gun perforations defined within the wellbore.

C. A downhole assembly, the downhole assembly including a first, second, and third downhole tools wherein the first friction-reducing sub operatively coupled to and interposing the first and second downhole tools. The second friction-reducing sub operatively coupled to and interposing the second and third downhole tools, wherein each friction-reducing sub includes an elongate body and one or more friction-reducing elements mounted to the elongate body, and wherein the friction-reducing elements are arranged at an outer diameter greater than an outer diameter of the first, second, and third downhole tools to enable the friction-reducing subs to support and centralize the first, second, and third downhole tools within a wellbore.

Each of embodiments A, B, and C may have one or more of the following additional elements in any combination: Element 1: wherein the downhole assembly further includes a bottom nose operatively coupled to and arranged downhole from the plug, the method further comprising; separating the plug from the downhole assembly following deployment within the wellbore; and removing the downhole assembly from the wellbore while leaving the plug, the bottom nose, and at least one of the one or more friction-reducing subs within the wellbore. Element 2: wherein the production zone comprises a first production zone and the wellbore further penetrates a second production zone located downhole from the first production zone and within twenty feet, and wherein deploying the plug within the wellbore comprises deploying the plug at a location within the wellbore between the first and second production zones. Element 3: wherein the production zone comprises a first production zone and the wellbore further penetrates a second production zone located downhole from the first production zone and within twenty feet, and wherein deploying the plug within the wellbore comprises deploying the plug at a location within the wellbore between the first and second production zones. Element 4: wherein the wellbore is deviated from vertical at an angle more than 65 degrees, and wherein conveying the downhole assembly into the wellbore further comprises: conveying the downhole assembly into the wellbore on wireline, engaging an inner wall of the wellbore with the one or more friction-reducing subs and thereby reducing friction generated between the downhole assembly and the inner wall of the wellbore. Element 5: wherein each friction-reducing sub includes an elongate body and one or more friction-reducing elements mounted to the elongate body, and wherein the friction-reducing elements are arranged at an outer diameter greater than an outer diameter of the perforating gun and the plug. Element 6: wherein the one or more friction-reducing elements comprise rolling wheels and engaging the inner wall of the wellbore with the one or more friction-reducing subs comprises providing rolling contact with the inner wall of the wellbore with the rolling wheels. Element 7: wherein conveying the downhole assembly into the wellbore is preceded by pumping a friction-reducing lubricant into the wellbore. Element 8: wherein the friction reducing lubricant comprises a brine lubricant. Element 9: wherein conveying the downhole assembly into the wellbore comprises conveying the downhole assembly into the wellbore on a conveyance selected from the group consisting of wireline, slickline, coiled tubing, and any combination thereof.

Element 10: wherein the downhole assembly further includes a perforation gun operable to create the perforation gun perforations in the wellbore. Element 11: wherein the wellbore is deviated from vertical at an angle more than 65 degrees, and wherein the downhole assembly further includes: a fishing neck arranged at an uphole end of the downhole assembly; and a wireline conveyance coupled to the fishing neck and operable to convey the downhole assembly into the wellbore, wherein the first and second friction-reducing subs engage an inner wall of the wellbore and thereby reduce friction generated between the downhole assembly and the inner wall of the wellbore. Element 12: wherein the plug, the second friction-reducing sub, and the bottom nose are decoupled from the downhole assembly after deploying the plug within the wellbore. Element 13: wherein the subterranean production zone comprises a first subterranean production zone and the wellbore further penetrates a second subterranean production zone located downhole from and within twenty feet of the first subterranean production zone. Element 14: wherein each friction-reducing sub includes an elongate body and one or more friction-reducing elements mounted to the elongate body, and wherein the friction-reducing elements are arranged at an outer diameter greater than an outer diameter of remaining components of the downhole assembly. Element 15: wherein the one or more friction-reducing elements comprise rolling wheels and engaging the inner wall of the wellbore with the one or more friction-reducing subs comprises providing rolling contact with the inner wall of the wellbore with the rolling wheels.

Element 16: The downhole assembly of claim 17, wherein the first, second, and third downhole tools are selected from the group consisting of a fishing neck, a correlation tool, a firing head, a perforating gun, a plug setting tool, a plug, and a bottom nose. Element 17: wherein the first downhole tool comprises a plug running tool, the second downhole tool comprises a plug, and the third downhole tool comprises a bottom nose, and wherein the first and second friction-reducing subs centralize the downhole assembly within the wellbore such that sealing elements included in the plug are not damaged while traversing perforation gun perforations defined within the wellbore. Element 18: wherein the wellbore is deviated from vertical at an angle more than 65 degrees, and wherein the downhole assembly further includes: a wireline conveyance coupled to the first downhole tool and operable to convey the downhole assembly into the wellbore, wherein the first and second friction-reducing subs engage an inner wall of the wellbore and thereby reduce friction generated between the downhole assembly and the inner wall of the wellbore.

By way of non-limiting example, exemplary combinations applicable to A, B and C include: Element 3 with Element 4; Element 4 with Element 5; Element 6 with Element 7; and Element 14 with Element 15.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore stimulation operation method, comprising:

conveying a downhole assembly into a wellbore a first time, the downhole assembly including a perforating gun and one or more friction-reducing subs operatively coupled to the perforating gun;

axially aligning the perforating gun with a production zone penetrated by the wellbore;

triggering operation of the perforating gun and thereby creating a plurality of perforations in the production zone;

removing the downhole assembly from the wellbore and replacing the perforating gun with a plug;

conveying the downhole assembly including the plug into the wellbore a second time;

axially aligning the plug with a location downhole from the plurality of perforations;

centralizing the plug within the wellbore with the one or more friction-reducing subs such that sealing elements included in the plug are not damaged while traversing the plurality of perforations; and deploying the plug within the wellbore downhole from the plurality of perforations.

2. The method of claim 1, wherein the downhole assembly further includes a bottom nose operatively coupled to and arranged downhole from the plug, the method further comprising;

separating the plug from the downhole assembly following deployment within the wellbore; and removing the downhole assembly from the wellbore while leaving the plug, the bottom nose, and at least one of the one or more friction-reducing subs within the wellbore.

3. The method of claim 1, wherein the production zone comprises a first production zone and the wellbore further penetrates a second production zone located downhole from the first production zone and within twenty feet, and wherein deploying the plug within the wellbore comprises deploying the plug at a location within the wellbore between the first and second production zones.

4. The method of claim 1, wherein the wellbore is deviated from vertical at an angle more than 65 degrees, and wherein conveying the downhole assembly into the wellbore further comprises:

conveying the downhole assembly into the wellbore on wireline; and engaging an inner wall of the wellbore with the one or more friction-reducing subs and thereby reducing friction generated between the downhole assembly and the inner wall of the wellbore.

5. The method of claim 4, wherein each friction-reducing sub includes an elongate body and one or more friction-reducing elements mounted to the elongate body, and wherein the friction-reducing elements are arranged at an outer diameter greater than an outer diameter of the perforating gun and the plug.

6. The method of claim 5, wherein the one or more friction-reducing elements comprise rolling wheels and engaging the inner wall of the wellbore with the one or more friction-reducing subs comprises providing rolling contact with the inner wall of the wellbore with the rolling wheels.

7. The method of claim 1, wherein conveying the downhole assembly into the wellbore is preceded by pumping a friction-reducing lubricant into the wellbore.

8. The method of claim 7, wherein the friction reducing lubricant comprises a brine lubricant.

9. The method of claim 1, wherein conveying the downhole assembly into the wellbore comprises conveying the downhole assembly into the wellbore on a conveyance selected from the group consisting of wireline, slickline, coiled tubing, and any combination thereof.

10. A well system, comprising:

an oil and gas platform;

a wellbore in communication with the oil and gas platform and penetrating a subterranean production zone;

a downhole assembly configured to be introduced into the wellbore and including:

a plug running tool;

a plug operatively coupled to the plug running tool and in communication therewith such that operation of the plug running tool causes the plug to actuate;

a first friction-reducing sub interposing the plug running tool and the plug, the plug running tool being operable to actuate the plug through the first friction-reducing plug;

a bottom nose operatively coupled to the plug; and a sacrificial second friction-reducing sub interposing the plug and the bottom nose;

wherein the first and second friction-reducing subs centralize the downhole assembly within the wellbore such that sealing elements included in the plug are not damaged while traversing perforation gun perforations defined within the wellbore, and wherein the plug, the sacrificial second friction-reducing sub, and the bottom nose are each decoupled from the downhole assembly after deploying the plug within the wellbore.

11. The well system of claim 10, wherein the downhole assembly further includes a perforation gun operable to create the perforation gun perforations in the wellbore.

12. The well system of claim 10, wherein the wellbore is deviated from vertical at an angle more than 65 degrees, and wherein the downhole assembly further includes:

a fishing neck arranged at an uphole end of the downhole assembly; and a wireline conveyance coupled to the fishing neck and operable to convey the downhole assembly into the wellbore, wherein the first friction-reducing sub and sacrificial second friction-reducing sub engage an inner wall of the wellbore and thereby reduce friction generated between the downhole assembly and the inner wall of the wellbore.

13. The well system of claim 10, wherein the subterranean production zone comprises a first subterranean production zone and the wellbore further penetrates a second subterranean production zone located downhole from and within twenty feet of the first subterranean production zone.

14. The well system of claim 10, wherein each friction-reducing sub includes an elongate body and one or more friction-reducing elements mounted to the elongate body, and wherein the friction-reducing elements are arranged at an outer diameter greater than an outer diameter of remaining components of the downhole assembly.

15. The method of claim 14, wherein the one or more friction-reducing elements comprise rolling wheels and engaging the inner wall of the wellbore with the one or more friction-reducing subs comprises providing rolling contact with the inner wall of the wellbore with the rolling wheels.

16. A downhole assembly, comprising:

first, second, and third downhole tools;

a first friction-reducing sub operatively coupled to and interposing the first and second downhole tools, the first and second downhole tools being in communication through the first friction-reducing sub;

a second friction-reducing sub operatively coupled to and interposing the second and third downhole tools, the second and third downhole tools being in communication through the second friction reducing sub, wherein each friction-reducing sub includes an elongate body and one or more friction-reducing elements mounted to the elongate body, and wherein the friction-reducing elements are arranged at an outer diameter greater than an outer diameter of the first, second, and third downhole tools to enable the friction-reducing subs to support and centralize the first, second, and third downhole tools within a wellbore.

17. The downhole assembly of claim 16, wherein the first, second, and third downhole tools are selected from the group consisting of a fishing neck, a correlation tool, a firing head, a perforating gun, a plug setting tool, a plug, and a bottom nose.

18. The downhole assembly of claim 16, wherein the first downhole tool comprises a plug running tool, the second downhole tool comprises a plug, and the third downhole tool comprises a bottom nose, and wherein the first and second friction-reducing subs centralize the downhole assembly within the wellbore such that sealing elements included in the plug are not damaged while traversing perforation gun perforations defined within the wellbore.

19. The downhole assembly of claim 18, wherein the plug, the second friction-reducing sub, and the bottom nose are each decoupled from the downhole assembly after deploying the plug within the wellbore.

20. The downhole assembly of claim 16, wherein the wellbore is deviated from vertical at an angle more than 65 degrees, and wherein the downhole assembly further includes:

a wireline conveyance coupled to the first downhole tool and operable to convey the downhole assembly into the wellbore, wherein the first and second friction-reducing subs engage an inner wall of the wellbore and thereby reduce friction generated between the downhole assembly and the inner wall of the wellbore.

* * * * *